US006835352B2

(12) United States Patent
Ito et al.

(10) Patent No.: US 6,835,352 B2
(45) Date of Patent: Dec. 28, 2004

(54) SPOTTING PIN

(75) Inventors: Seiichiro Ito, Tokyo (JP); Mitsuhiro Tachibana, Tokyo (JP)

(73) Assignee: Hitachi Software Engineering Co., Ltd., Kanagawa (JP)

( * ) Notice: Subject to any disclaimer, the term of this patent is extended or adjusted under 35 U.S.C. 154(b) by 230 days.

(21) Appl. No.: 10/434,214

(22) Filed: May 9, 2003

(65) Prior Publication Data

US 2003/0215368 A1 Nov. 20, 2003

(30) Foreign Application Priority Data

May 20, 2002 (JP) ..... 2002-145130

(51) Int. Cl.[7] ..... B01L 3/02

(52) U.S. Cl. ..... 422/100; 422/99; 436/180; 73/864.02; 73/864.72; 347/110

(58) Field of Search ..... 422/99, 100; 73/864.02, 73/864.72; 436/180; 400/124.14, 124.15, 124.29; 347/110; 101/327, 368

(56) References Cited

U.S. PATENT DOCUMENTS 4,728,214 A * 3/1988 Mutschler ..... 401/258
5,957,167 A * 9/1999 Feygin ..... 141/31
6,110,426 A 8/2000 Shalon et al.
6,116,297 A 9/2000 Feygin
6,309,891 B1 * 10/2001 Shalon et al. ..... 436/180

FOREIGN PATENT DOCUMENTS

WO WO 00/25923 11/1999

* cited by examiner

*Primary Examiner*—Jan M. Ludlow
(74) *Attorney, Agent, or Firm*—Reed Smith LLP; Stanley P. Fisher, Esq.; Juan Carlos A. Marquez, Esq.

(57) ABSTRACT

A spotting pin 10 capable of spotting equal amounts of a solution in a sequential manner comprises a first member 11 having a solution holding portion 13 formed at the tip thereof for holding a predetermined amount of solution, and a second member 12 having a solution supply portion 14 for holding the solution by a capillary action, the second member adapted to slide along the first member. As the solution supply portion 14 is brought into contact with the solution holding portion 13, the solution enters the solution holding portion 13 from the solution supply portion 14 by a capillary action. As the solution supply portion 14 and the solution holding portion 13 are separated from each other, a predetermined amount of the solution can be carried in the solution holding portion 13. Then, as the solution holding portion 13 is brought into contact with a water-absorbing support 21, a spot 22 of a predetermined amount of the solution can be formed thereon.

11 Claims, 11 Drawing Sheets

10

15
14
16
12
18

17
13
11

40
41
42
43
44
45
46
51
52
21
22

SPOTTING PIN

BACKGROUND OF THE INVENTION

1. Technical Field

The present invention relates to a macroarray spotting pin for spotting a spotting solution containing biopolymers on a water-absorbing support, such as a nylon membrane, during the macroarray manufacturing process.

2. Background Art

Macroarrays are conventionally manufactured by spotting multiple kinds of spotting solutions containing biopolymers such as DNA, RNA, and proteins on a support, such as a nylon membrane. FIG. 13 illustrates the principle of manufacture of a macroarray. A microplate 132 houses multiple kinds of spotting solutions to be spotted, including a DNA solution 131. The support for the macroarray is comprised of a nylon membrane 134. The DNA solution 131 is carried by a spotting pin 133 and then spotted on the nylon membrane 134, and this process is repeated, thereby producing a plurality of macroarrays 135 on which the multiple kinds of DNA solutions are spotted. Various types of spotting pins for the manufacture of macroarrays have been developed. Examples include a split-type pin capable of sequential spotting based on the capillary action similar to that which occurs in the fountain-pen tip, and a solid-type pin in which a spotting solution is caused to adhere to the pin tip before each stamping.

In order for the results obtained from the macroarray to be reliable, it is necessary to accurately grasp how much of the spotting solution containing biopolymers such as DNA, RNA and proteins is fixed at each spot on the macroarray. It is difficult, however, to quantitatively spot with the solid-type pins. While the split-type pins are advantageous in that they do not require the solution to be adhered to the tip of the pins before each spotting and that they are resistant to drying, for example, it is still difficult to sequentially spot equal amounts.

SUMMARY OF THE INVENTION

It is an object of the invention to provide a spotting pin capable of spotting equal amounts of multiple kinds of spotting solutions containing biopolymers on a water-absorbing support used in biological experiments in a stable and sequential manner.

The above object is achieved by a spotting pin according to the invention which is capable of carrying a solution based on the capillary phenomena and which can have its tip split.

In one aspect, the invention provides a spotting pin for spotting a solution on a water-absorbing support, comprising:

- a first member comprising a solution holding portion opening into a front and back surface of the tip of the first member which comes into contact with a support, the first member holding a predetermined amount of solution in the solution holding portion based on a capillary action, the first member further comprising a slide guide portion;
- a second member comprising a solution supply portion opening into an end of the second member opposite the opening on the back surface of the solution holding portion, the solution supply portion holding the solution based on a capillary action, wherein the second member slides along the slide guide portion of the first member; and

- a biasing member for urging the second member against the first member such that the solution supply portion of the second member comes into contact with the solution holding portion of the first member.

By bringing the solution supply portion of the second member into contact and communication with the solution holding portion of the first member, the solution in the solution supply portion can be filled into the solution holding portion of the first member by a capillary action. Then, the second member is caused to slide relative to the first member against the force of the biasing member, in order to separate the solution holding portion of the first member and the solution supply portion of the second member. As a result, a predetermined amount of the solution is carried in the through-hole of the first member due to a capillary action. Next, the tip of the first member is brought into contact with the absorptive support, so that the predetermined amount of solution carried by the solution holding portion of the first member is absorbed into the absorptive support, forming a spot. Thereafter, the solution supply portion of the second member is brought into contact with the solution holding portion of the first member by the force of the biasing member. Consequently, the solution holding portion of the first member that has been empty can be re-filled with the solution from the solution supply portion due to a capillary action. By repeating this sequence, equal amounts of the solution can be sequentially spotted on the absorptive support.

The second member may comprise a body and a branch portion extending from the body in a direction opposite the tip of the first member. In this case, the branch portion acts as a mount via which the spotting pin can be fixed to the pin head of spotting equipment. The first member is driven relative to the second member by a pin or the like protruding from the pin head of the spotting equipment.

The second member may comprise a body and a branch portion extending from the body in a direction of the tip of the first member, and the tip of the branch portion may protrude beyond the tip of the first member when the solution supply portion of the second member is in contact with the solution holding portion of the first member. In this case, the branch portion comes into contact with the support and thus functions as a stopper for separating the solution holding portion of the first member from the solution supply portion of the second member. The spotting pin is fixed to the spotting equipment by having the rear end of the first member fixed to the pin head.

By providing the second member with a large-sized solution reservoir communicated with the solution supply portion, a large amount of a biopolymer solution can be supplied to the spotting pin, so that more spots can be created at once by a single charging of the solution. In this case, a line connecting the tip of the first member and the center of the solution reservoir may be either parallel or non-parallel to the sliding direction of the second member.

Preferably, the periphery of the tip surface of the first member is cut in order to reduce the area of contact with the support. It is also preferable that the periphery of the tip of the second member opposite the back surface of the tip of the first member be cut in order to reduce the area of contact with the back surface of the tip of the first member. By thus cutting the periphery of the tip of the first member and that of the solution supply end of the second member, the movement of the solution by a capillary action can be facilitated, making it possible to create solution spots of the same shape on the support such as a highly water-absorbing nylon membrane in a stable and sequential manner.

The biasing member may be a compression spring disposed between the inner wall of the rear end of the first member and the second member. The compression spring acts to push the second member in the direction of the tip of the first member.

The first and second members may be made of austenitic stainless steel. By using austenitic stainless steel as the material for the spotting pin, the strength and acid and chemical resistance can be improved.

To realize a smooth movement of the spotting pin and extend its life, the sliding portions of the first and second members are preferably diamond-coated.

In another aspect, the invention provides a spotting pin for spotting a solution on a water-absorbing support, comprising:

a first member comprising a plurality of solution holding portions each having an opening on a front and back surface of the tip of the first member which comes into contact with the support, and a slide guide portion, each solution holding portion holding a predetermined amount of the solution based on a capillary action;

a second member comprising a plurality of solution supply portions each having an opening on an end of the second member opposite the opening on the back surface of the solution holding portion and holding the solution based on a capillary action, wherein the second member slides along the slide guide portion of the first member; and a biasing member for urging the second member against the first member such that the multiple solution supply portions of the second member come into contact with the multiple solution holding portions of the first member.

This spotting pin is an application of the principle of the spotting pins described above, and it comprises a plurality of solution supply portions and pin tips that are connected to one another. This embodiment allows multiple spots to be simultaneously formed on the water-absorbing support. By making the first and second members with plastics, a disposable spotting pin can be provided at reduced costs. Further, contamination of the solution, which is potentially problematic for recycling purposes, can be avoided.

The spotting pin according to the invention can be used for spotting any kind of biopolymers, such as DNA, RNA, proteins, and mixtures thereof. As the water-absorbing support, film-like supports in general with water-absorbing properties for macroarray purposes, such as nylon membranes, can be used.

DESCRIPTION OF THE INVENTION

Embodiments of the invention will be hereafter described with reference made to the drawings.

Figures 1A, 1B, 1C:
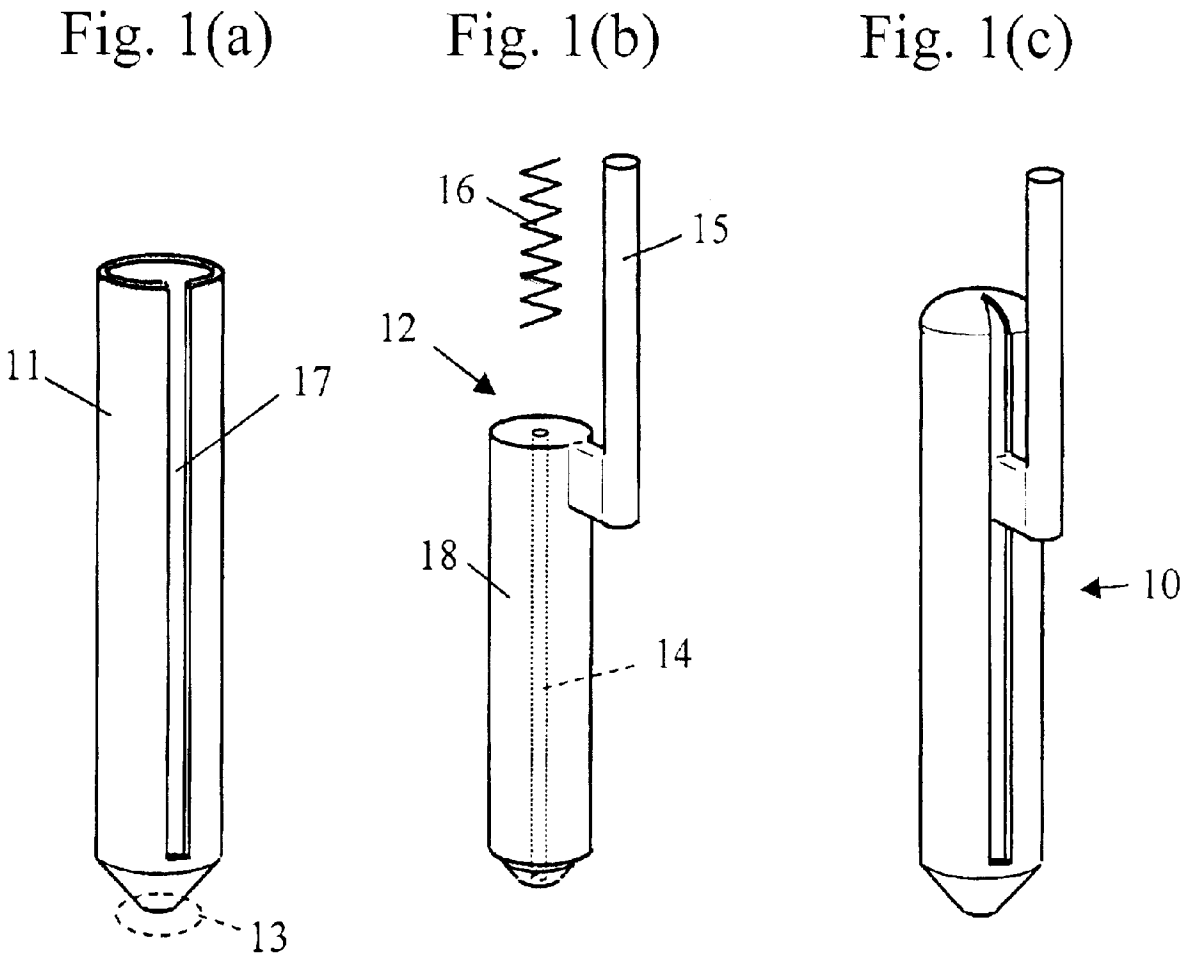
FIGS. 1(*a*) to 1(*c*) show an example of the spotting pin according to the invention as assembled and dissembled.

FIGS. 1(*a*) to 1(*c*) show assembled and disassembled views of an example of the spotting pin according to the invention.

A spotting pin 10 includes a second member 12 that is slidably accommodated within an outer, cylindrical first member 11. The first member 11 includes a solution holding portion 13 formed at the tip thereof. The solution holding portion 13 is formed by a capillary tube of about 0.05 to 0.5 mm in diameter and about 0.5 to 2 mm in length. The volume of the solution holding portion 13 may be in the range of from 4 to 1600 nL. The second member 12 includes a cylindrical body 18 provided with a solution supplying portion 14 formed along the center axis thereof. The solution supplying portion 14 is formed by a relatively long capillary tube of about 0.05 to 0.5 mm in diameter. The second member 12 also includes an L-shaped branch portion 15 extending once sideways from a rear end of the body and then extending in parallel with the central axis of the body towards its rear.

The spotting pin 10 is assembled as follows. First, a slit 17 is formed in the side wall of the cylindrical first member 11 along the axis thereof as shown in FIG. 1(*a*), the first member 11 having the solution holding portion 13 at the tip formed by the capillary tube. Then, as shown in FIG. 1(*b*), the second member 12 and a compression spring 16 are inserted into the first member 11, with the L-shaped branch portion 15 extending from the body 18 of the second member 12 sliding along the slit 17. Finally, the end of the cylindrical first member 11 is closed, as shown in FIG. 1(*c*). The thus obtained spotting pin 10 is then mounted on spotting equipment (not shown) by securely attaching the tip of the L-shaped branch portion 15 extending from the second member 12 to a pin head of the spotting equipment.

The compression spring 16 inserted in the rear space of the first member 11 urges the body 18 of the second member 12 towards the tip of the first member 11. The first and second members 11 and 12 are made of austenitic stainless steel, which has excellent mechanical strength as well as acid and chemical resistance. The inner wall and the slit 17 of the first member 11 acts as a guide as the surface of the body 18 of the second member 12 axially slides on the inner wall of the first member 11. When there is no external force applied, the body 18 of the second member 12 is urged toward the tip of the first member by the action of the compression spring 16. As a result, the capillary tube constituting the solution holding portion 14 of the second member 12 is brought into contact and communicated with the capillary tube constituting the solution holding portion 13 formed at the tip of the first member 11, forming a single long continuous tube at the center of the spotting pin. As the second member 12 slides relative to the first member 11 in the direction of compressing the compression spring 16, a gap is created between the solution holding portion 13 of the first member 13 and the solution supply portion 14 of the second member 12. When the second member 12 slides in the first member 11, the slit 17 of the first member 11 acts as an air passage allowing the air sealed inside the first member to be let out or the outside air to be introduced into the first member.

The tip of the cylindrical first member 11 has its periphery cut such that it has a reduced area of contact with the support. Similarly, the tip of the second member 12 opposite the solution holding portion 13 of the first member 11 has its periphery cut such that it has a reduced area of contact with the back surface of the tip of the first member.

Figures 2A, 2B, 2C, 2D:
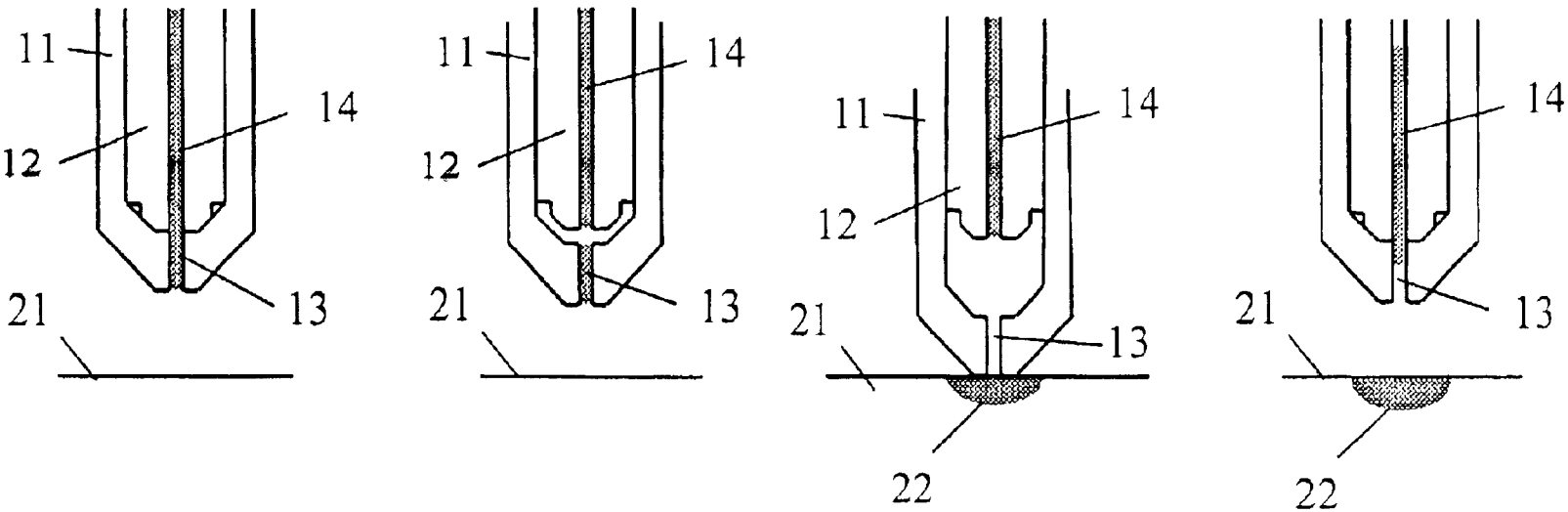
FIGS. 2(*a*) to 2(*d*) illustrate the spotting operation of the spotting pin according to the invention.

FIGS. 2(*a*) to 2(*d*) illustrate the operation of the spotting pin shown in FIG. 1(*c*) as it spots a solution of DNA or the like on a water-absorbing support such as, for example, a nylon membrane.

When the solution supply portion 14 of the second member 12 is in contact with the solution holding portion 13 of the first member 11 by the action of the compression spring, the capillary tube constituting the solution holding portion of the first member is communicated with the capillary tube constituting the solution supply portion of the second member. Thus the capillary tubes act as if they were a single capillary tube, when the tip of the first member 11 is dipped into the DNA solution. As a result, the DNA solution travels through the solution holding portion 13 of the first member 11 based on a capillary action and fills the solution supply portion 14 of the second member 12, as shown in FIG. 2(*a*).

When the solution holding portion 13 of the first member 11 and the solution supply portion 14 of the second member 12 are continuously filled with the DNA solution, the second member 12 is caused to slide within the first member 11 against the force of the compression spring 16, as shown in FIG. 2(*b*). This causes the capillary tube constituting the solution holding portion 13 of the first member 11 be separated from the capillary tube constituting the solution supply portion 14 of the second member 12, thus severing the capillary action at the point of separation. The DNA solution remains in the solution holding portion 13 of the first member 11 due to the capillary action. In the solution holding portion 13, a predetermined amount of the DNA solution remains which is determined by the dimensions of the capillary tube forming the solution holding portion.

Then, with the DNA solution held by the solution holding portion 13 of the first member 11, and with the solution holding portion 13 of the first member 11 separated from the solution supply portion 14 of the second member 12, the tip of the first member 11 is brought into contact with the water-absorbing support 21, such as a nylon membrane. As a result, the DNA solution held by the solution holding portion 13 of the first member 11 is absorbed by the water-absorbing support 21, thus forming a spot 22, as shown in FIG. 2(*c*).

After the spot 22 is formed on the water-absorbing support 21, the tip of the first member 11 is raised above the water-absorbing support 21, with the solution holding portion 13 of the first member 11 still separated from the solution supply portion 14 of the second member 12. The solution holding portion 13 of the first member 11 is now empty. Then, the solution holding portion 13 of the first member 11 is brought into contact with the solution supply portion 14 of the second member 12 by the action of the compression spring 16, as shown in FIG. 2(*d*). This causes the capillary tube constituting the solution holding portion of the first member 11 to be once again communicated with the capillary tube constituting the solution supply portion 14 of the second member 12, thus forming a single capillary tube. As a result, the solution held by the solution supply portion 14 of the second member 12 is shifted to the solution holding portion 13 of the first member 11 by the capillary action, thus filling the solution holding portion 13.

Thus the sequence comes back to the state as shown in FIG. 2(*a*). By repeating this sequence from FIG. 2(*a*) to FIG. 2(*d*), a predetermined amount of solution can be sequentially spotted on a plurality of nylon membranes.

Figure 3B:
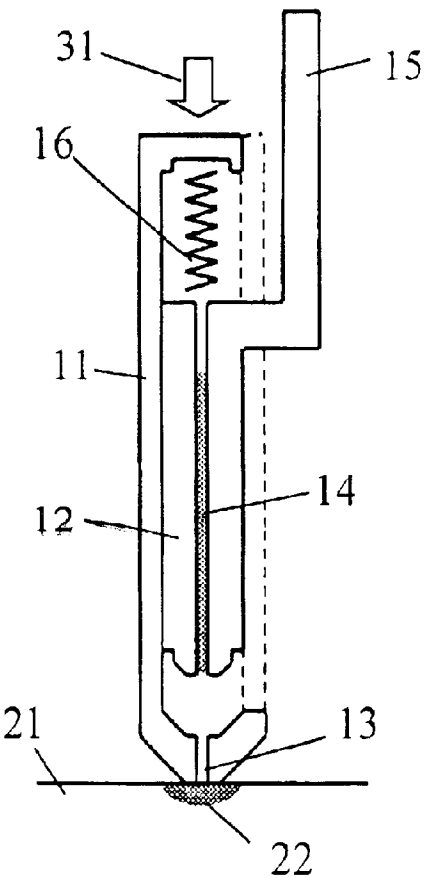
FIGS. 3(*a*) and 3(*b*) show typical states of the spotting pin in operation.
Figure 3A:
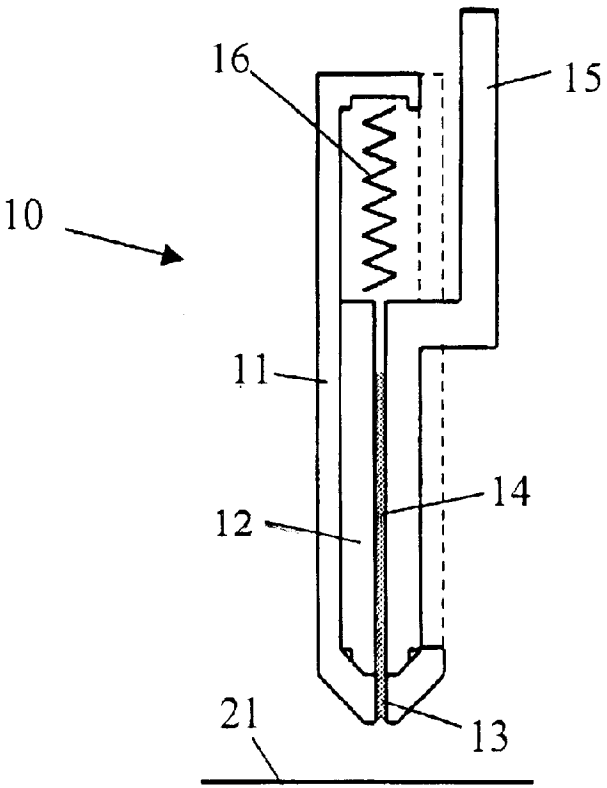

FIGS. 3(*a*) and 3(*b*) schematically show typical states of the spotting pin in operation. The branch portion 15 of the second member 12 of the spotting pin 10 is fixed to a pin head of spotting equipment (not shown), such that the spotting pin 10 as a whole moves up and down in response to the up/down movement of the pin head. FIG. 3(*a*) shows the spotting head in a standby state, corresponding to FIG. 2(*a*). FIG. 3(*b*) shows the spotting head in an operating state, corresponding to FIG. 2(*c*). In FIG. 3(*b*), because the second member 12 of the spotting pin 10 is fixed to the pin head of the spotting equipment, it does not move. On the other hand, the first member 11 is pushed downward away from the pin head in the direction indicated by an arrow 31, and the tip comes into contact to the water-absorbing support 21. As a result, the predetermined amount of solution held by the solution holding portion 13 at the tip of the first member 11 is absorbed by the water-absorbing support 21, forming a spot 22.

The compression spring 16 mounted inside the spotting pin 10 allows the pushing force to be controlled, which makes it possible to stabilize the spot shape and extend the life of the spotting pin.

Figure 4A:
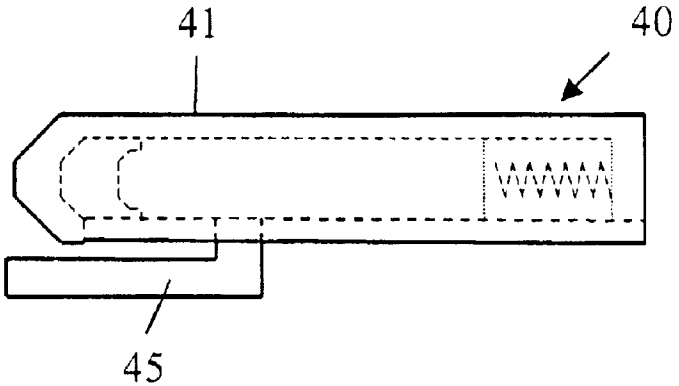
FIGS. 4(*a*) and 4(*b*) show another example of the spotting pin according to the invention.
Figure 4B:
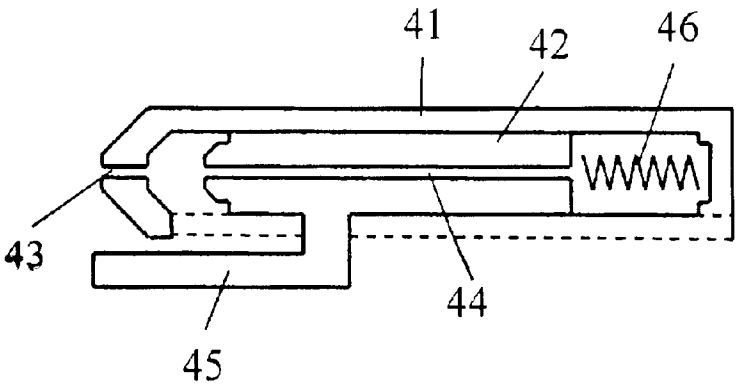

FIGS. 4(*a*) and 4(*b*) show another embodiment of the spotting pin according to the invention. FIG. 4(*a*) is a side view, and FIG. 4(*b*) is a cross-sectional view. While the spotting pin shown in FIGS. 4(*a*) and 4(*b*) differs from that shown in FIGS. 1(*a*) to 1(*c*) in the structure of a branch portion 45 extending from the body of the second member 12, other portions are substantially similar. Accordingly, the following description of the second embodiment is mainly concerned with the differences from the spotting pin shown in FIGS. 1(*a*) to 1(*c*). In FIGS. 4(*a*) and 4(*b*), a spotting pin 40 is depicted as a second member 42 is urged in the direction of compressing a compression spring 46 for ease of understanding of the structure.

In the second embodiment, the L-shaped branch portion 45 extending from the body of the second member 42 extends forward along the axis, as opposed to that in the first embodiment shown in FIG. 1(*c*). When the solution supply portion 44 of the second member 42 is brought into contact and communicated with the solution holding portion 43 of the first member 41 by the compression spring 46, the tip of the L-shaped branch portion 45 protrudes beyond the tip of the first member 41. The L-shaped branch portion 45 in this case does not function as a mount via which the spotting pin is attached to the pin head of the spotting equipment. Instead, it functions as a stopper, as will be described later. The spotting pin 40 of the present embodiment is mounted on the spotting equipment by fixing the rear end of the first member 41 to the pin head of the spotting equipment.

Figures 5A, 5B, 5C, 5D:
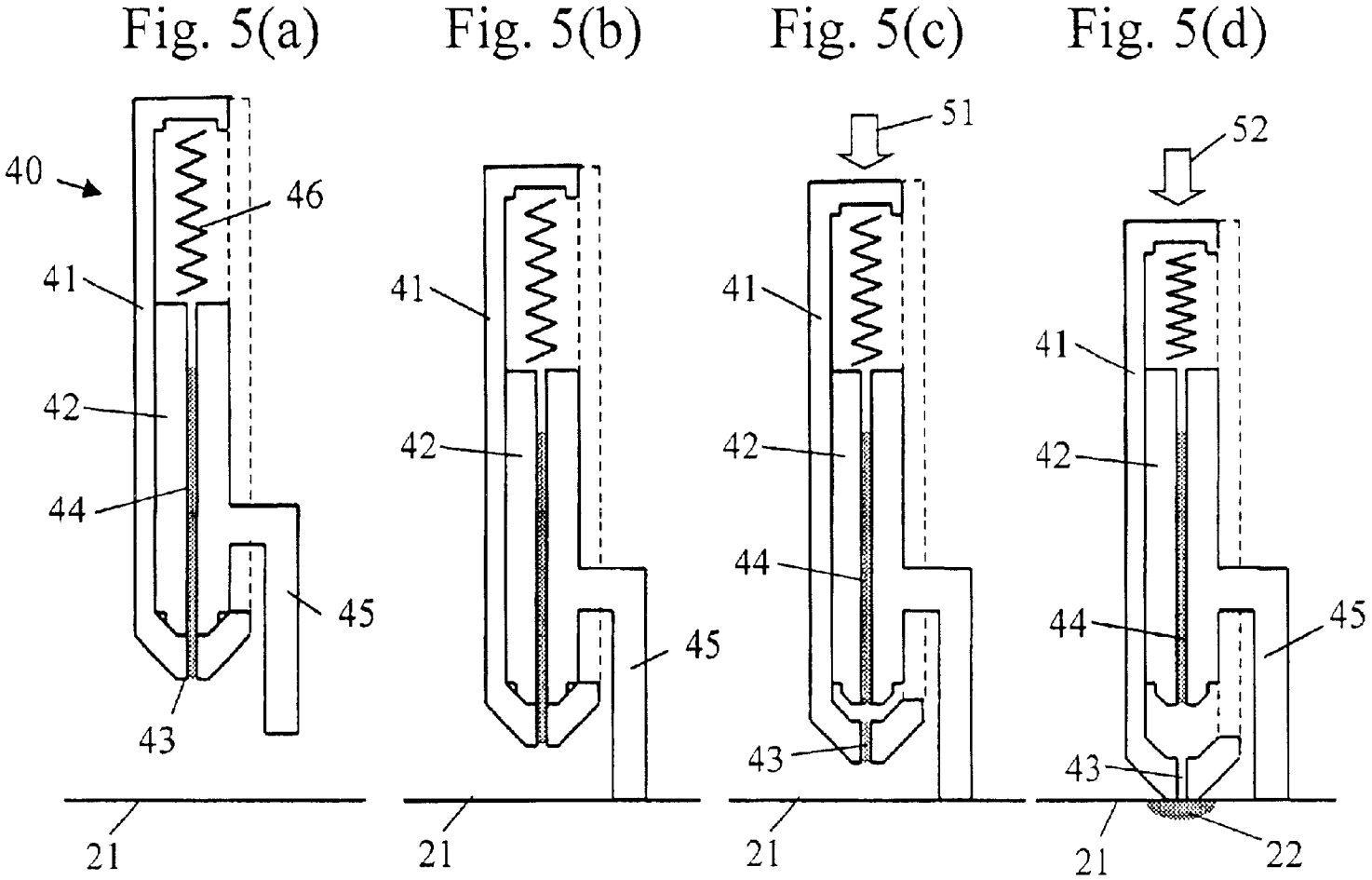
FIGS. 5(*a*) to 5(*d*) illustrate the spotting operation.

FIGS. 5(*a*) to 5(*c*) schematically show the spotting operation of the spotting pin 40 shown in FIGS. 4(*a*) and 4(*b*). The rear end of the first member 41 is fixed to the pin head of the spotting equipment, so that as the pin head moves up and down, the spotting pin 40 also moves up and down as a whole. In this embodiment, the pin head only requires a mechanism for fixing the spotting pin 40 and does not require such an additional mechanism for pushing down the pin head as required by the pin head to which the spotting pin of FIG. 1(*c*) is fixed.

FIG. 5(*a*) shows the spotting pin 40 as it is positioned above a planned spotting position on the water-absorbing support 21. As the spotting equipment lowers the pin head toward the water-absorbing support 21, the tip of the L-shaped branch portion 45 of the second member 42 comes into contact with the support 21 first, as shown in FIG. 5(*b*). As the pin head is further lowered, as shown in FIG. 5(*c*), to thereby push the first member 41 as indicated by an arrow 51, only the first member 41 slides downward against the force of the compression spring 46, with the downward movement of the second member 42 blocked by the L-shaped branch portion 45. Consequently, the solution holding portion 43 of the first member 41 separates from the solution supply portion 44 of the second member 42, and a predetermined amount of solution is separately carried by the capillary tube constituting the solution holding portion 43 due to the capillary action. The amount of the solution carried by the solution holding portion 43 is determined by the dimensions of the capillary tube constituting the solution holding portion 43. Referring now to FIG. 5(*d*), as the spotting pin 40 is further lowered and the first member 41 is pushed downward as indicated by an arrow 52, the tip of the first member 41 comes into contact with the support 21, whereupon the solution held by the solution holding portion 43 shifts to the water-absorbing support 21 and forms a spot 22.

After the formation of the spot 22 on the water-absorbing support 21, the pin head is raised. The solution holding portion 43 of the first member 41 is eventually brought into contact with the solution supply portion 44 of the second member 42 by the action of the compression spring 46. A portion of the solution held by the solution supply portion 44 of the second member 42 then shifts into the solution holding portion 43 of the first member 41 based on the capillary action, thus filling the solution holding portion 43. The sequence of events thus comes back to the state shown in FIG. 5(*a*). By repeating the sequence of operation depicted from FIG. 5(*a*) to FIG. 5(*d*), a predetermined amount of solution can be sequentially spotted onto a plurality of water-absorbing supports 21.

Figure 6:
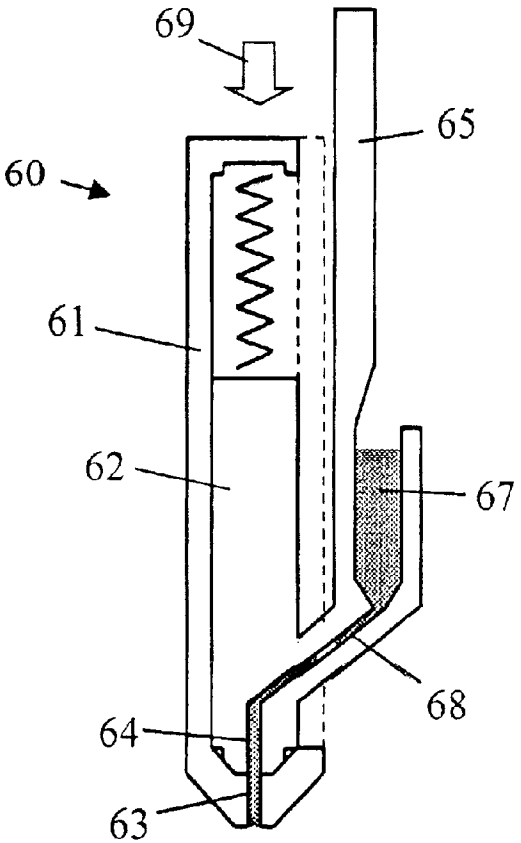
FIG. 6 shows a cross-sectional view of another example of the spotting pin according to the invention.

FIG. 6 is a cross-sectional view of another embodiment of the spotting pin according to the invention. A spotting pin 60 is similar to the spotting pin shown in FIG. 1(*c*) except that a solution reservoir is provided. A first member 61 includes a capillary tube formed at the tip constituting a solution holding portion 63. A second member 62 includes a solution reservoir 67 formed in an L-shaped branch portion 65. The L-shaped branch portion 65 extends toward the rear of the spotting pin and functions as a mount to be fixed to the pin head. The solution reservoir 67 is communicated with a capillary tube constituting a solution supply portion 64 of the body of the second member via a flow passage 68 with a bend. The pin tip is located directly below the point of application of a force 69 applied to move the spotting pin upward or downward. The solution reservoir 67 is capable of storing a large quantity of solution. Thus, the spotting pin 60 according to this embodiment allows spots of equal amounts to be sequentially formed on a number of supports with a single filling of the solution.

Figure 7:
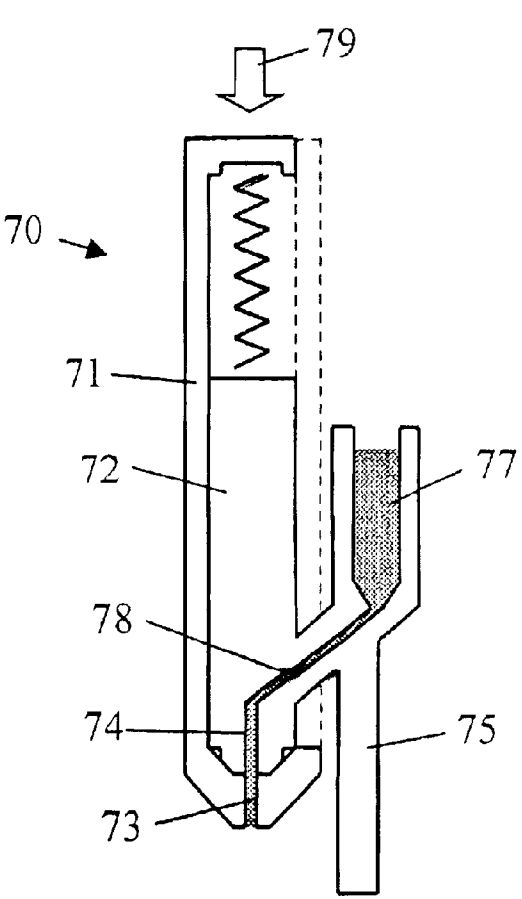
FIG. 7 shows a cross-sectional view of another example of the spotting pin according to the invention.

FIG. 7 shows a cross section of another embodiment of the spotting pin according to the invention. This spotting pin is similar to that shown in FIGS. 4(*a*) and 4(*b*) except that a solution reservoir is added. A first member 71 includes a capillary tube formed at the tip thereof constituting a solution holding portion 73. A second member 72 is provided with a solution reservoir 77 formed above a branch portion 75 that extends toward the tip of the pin and which functions as a stopper. The solution reservoir 77 is communicated with a capillary tube constituting a solution supply portion 74 of the body of the second member 72 by a flow passage 78 with a bend. The tip of the pin is located directly below the point of application of a force 79 applied from the pin head for the upward or downward movement. The solution reservoir 77 is capable of storing a large quantity of solution. Thus, the spotting pin 70 allows spots of equal amounts to be sequentially formed on a number of supports with a single filling of the solution.

Figure 8B:
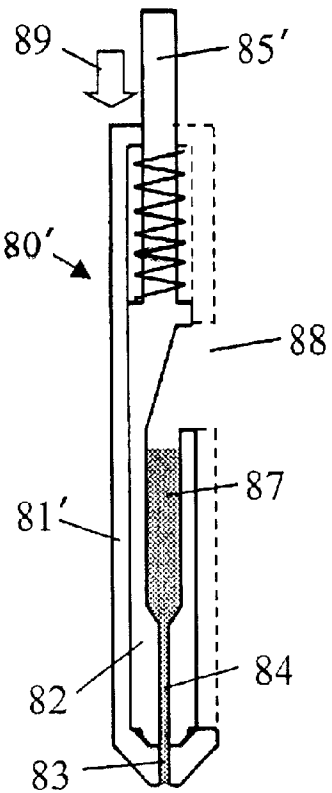
FIGS. 8(*a*) and 8(*b*) show a cross-sectional view of yet another example of the spotting pin according to the invention.
Figure 8A:
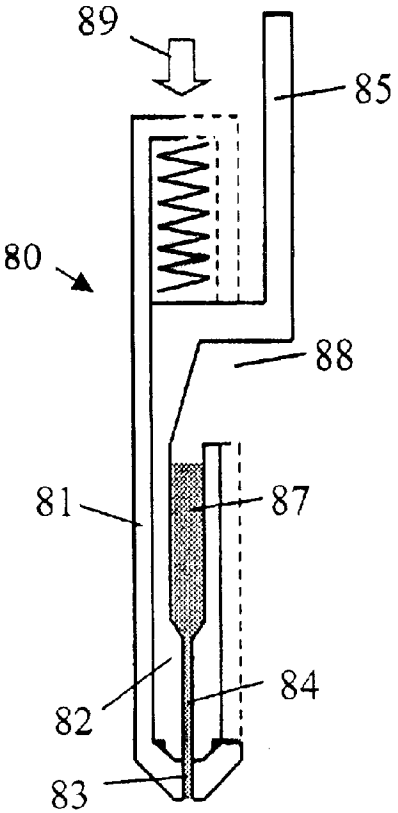

FIGS. 8(*a*) and (*b*) show cross-sectional views of yet another embodiment of the spotting pin according to the invention. Spotting pins 80 and 80' illustrated are variations of the spotting pins described with reference to FIGS. 1 to 3, in which a solution reservoir 87 is provided in a second member 82. A cylindrical first member 81 includes a capillary tube formed at the tip constituting a solution holding portion 83. A second member 82 includes a solution reservoir 87 formed above a capillary tube constituting a solution supply portion 84 from which a solution is supplied to the solution holding portion 83 of the first member 81. A slit is formed in the first member 81 along the axis thereof. A portion of the slit is enlarged in a peripheral direction in the shape of a window. The window forms a solution inlet 88 via which a solution can be delivered into the solution reservoir 87. The solution reservoir 87 is capable of storing a large quantity of solution, so that spots of equal amounts can be sequentially formed on a number of supports with a single filling of the solution.

The spotting pin 80 shown in FIG. 8(*a*) includes an L-shaped branch portion 85 that protrudes sideways from the rear end of the body of the second member 82 and then extends backward along the central axis of the body. The spotting pin 80' shown in FIG. 8(*b*) includes a linear branch portion 85' that extends from the rear end of the body of the second member 82 along the central axis of the body and protrudes through an opening formed in the rear end of the first member 81'.

The inner walls and the axial slits in the first members 81 and 81' act as a slide guide when the second member 82 slides on the inner walls of the first members 81 and 81' against the force of the compression spring 86. The upper end of the branch portions 85 and 85' extending upward from the second member provides a mount for fixing the spotting pin to the pin head of the spotting equipment, while the upper end of the first member 81 receives a force 89 from the pin head.

Figure 9:
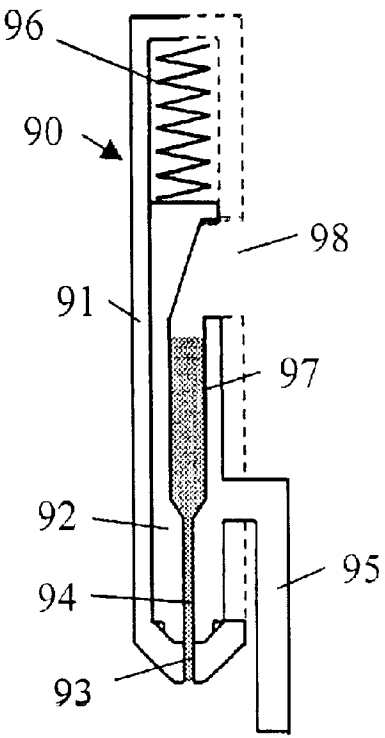
FIG. 9 shows a cross-sectional view of yet another example of the spotting pin according to the invention.

FIG. 9 shows a cross-section of yet another embodiment of the spotting pin according to the invention. A spotting pin 90 is similar to that shown in FIGS. 4(*a*) and 4(*b*) except that a solution reservoir is added. The spotting pin 90 is also similar to the spotting pin 70 shown in FIG. 7, but the location of the solution reservoir is different.

A first member 91 includes a capillary tube formed at the tip thereof constituting a solution holding portion 93. The upper end of the first member 91 is fixed to the pin head of the spotting equipment. A second member 92 includes a capillary tube constituting a solution supply portion 94 for supplying the solution to the solution holding portion 93, and a solution reservoir 97 provided at the top of the solution supply portion 94. From the second member 92 extends an L-shaped branch portion 95 that functions as a stopper, protruding sideways via a slit formed in the first member 91 and then extending forward. A portion of the slit formed along the axis of the first member 91 is enlarged in a peripheral direction in the shape of a window. The window forms a solution inlet 98 through which the solution can be delivered to the solution reservoir 97 of the second member 92. As the solution reservoir 97 is capable of storing a large quantity of solution, spots of equal amounts can be sequentially formed on a number of supports with a single filling of the solution. The inner wall and the slit of the first member 91 acts as a slide guide when the second member 92 slides on the inner wall of the first member 91 against the force of the compression spring 96.

Figure 10A:
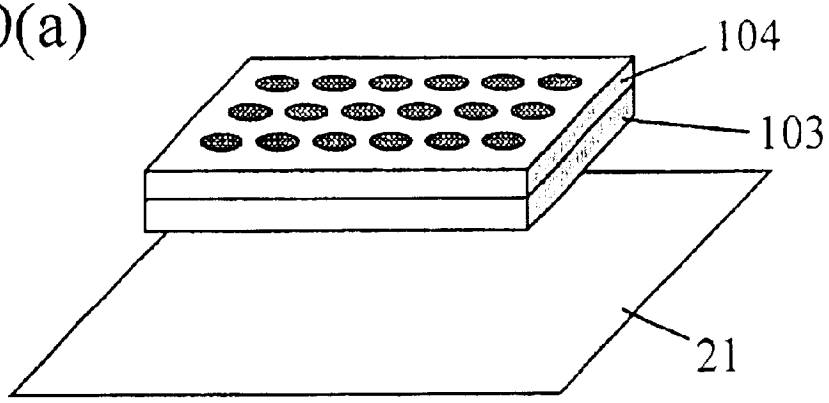
FIGS. 10(*a*) and 10(*b*) illustrate another example of the spotting pin according to the invention.
Figure 10B:
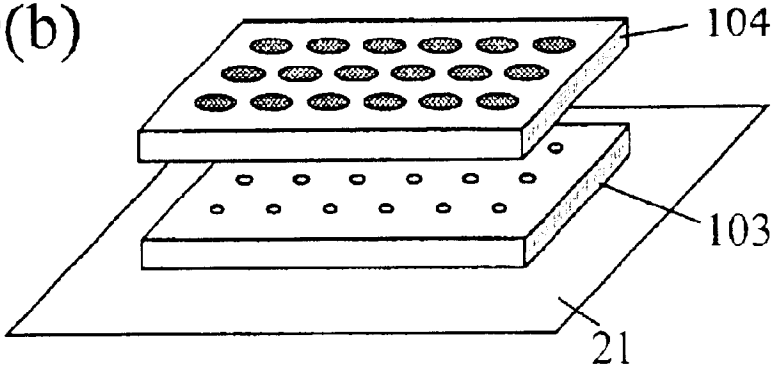

FIGS. 10(*a*) and 10(*b*) show another embodiment of the spotting pin according to the invention. The spotting pin is comprised of a member 104 having a plurality of solution-reservoir equipped solution supply portions coupled with another member 103 having a plurality of solution holding portions (capillary tubes). This spotting pin is capable of forming a plurality of spots at once. The member 104 with the multiple solution-reservoir equipped solution supply portions and the member 103 with the multiple solution holding portions can be either in contact with one another, as shown in FIG. 10(*a*), or separated away from one another, as shown in FIG. 10(*b*). Experiments can be facilitated if the specification of the solution reservoirs is brought into conformity with that of the 96-well or 384-well microplates. By using only the member 103 with the multiple solution holding portions, multiple kinds of DNA solutions can be quantitatively and simultaneously spotted on a water-absorbing support.

Further, by using the member 103 with the multiple solution holding portions together with the member 104, multiple kinds of DNA solutions can be sequentially and quantitatively spotted. The two plates 103 and 104 can be detachably mounted on the spotting equipment. In this case, there is no need for a microplate for storing biopolymers. By forming the member 104 having the multiple solution-reservoir equipped solution supplying portions with plastics, the member 104 can be manufactured cheaply and made disposable, and also the contamination of the solution can be prevented.

Figure 11A:
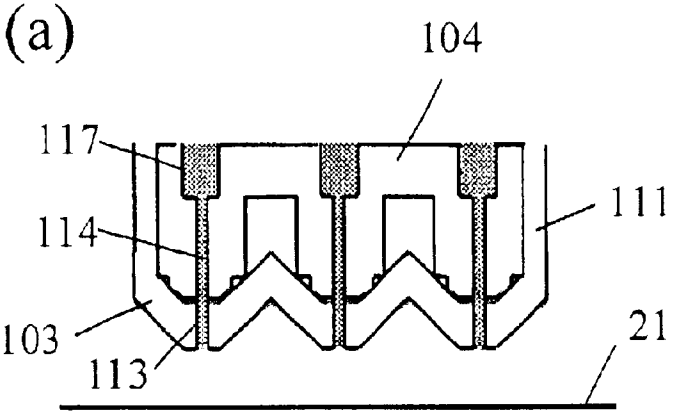
FIGS. 11(*a*) and 11(*b*) show a cross-sectional view showing the multiple-connection spotting pin shown in FIGS. 10(*a*) and 10(*b*) in detail.
Figure 11B:
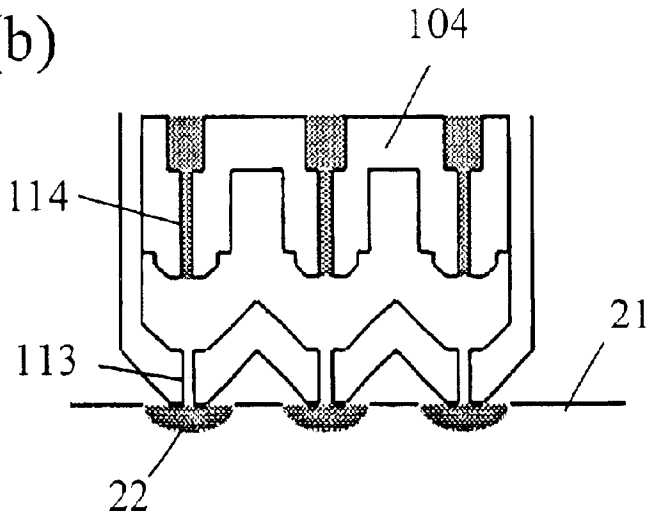

FIGS. 11(*a*) and 11(*b*) show cross-sectional views of another example of the structure of the spotting pin which allows a plurality of quantitative spots to be formed at once. FIG. 11(*a*) corresponds to FIG. 10(*a*), while FIG. 11(*b*) corresponds to FIG. 10(*b*).

The member 104 with the multiple solution-reservoir equipped solution supply portions include multiple groups of multiple capillary tubes constituting the solution supply portions 114 and multiple large-sized solution reservoirs 117 connected to the corresponding capillary tubes. The member 103 with the multiple solution holding portions include multiple capillary tubes constituting solution holding portions 113. The inner wall 111 of the member 103 functions as a guide along which the member 104 can slide on the member 103. Each of the solution holding portions 113, solution supply portions 114, and solution reservoirs 117 are grouped to form an independent spotting pin as described above.

Figure 12:
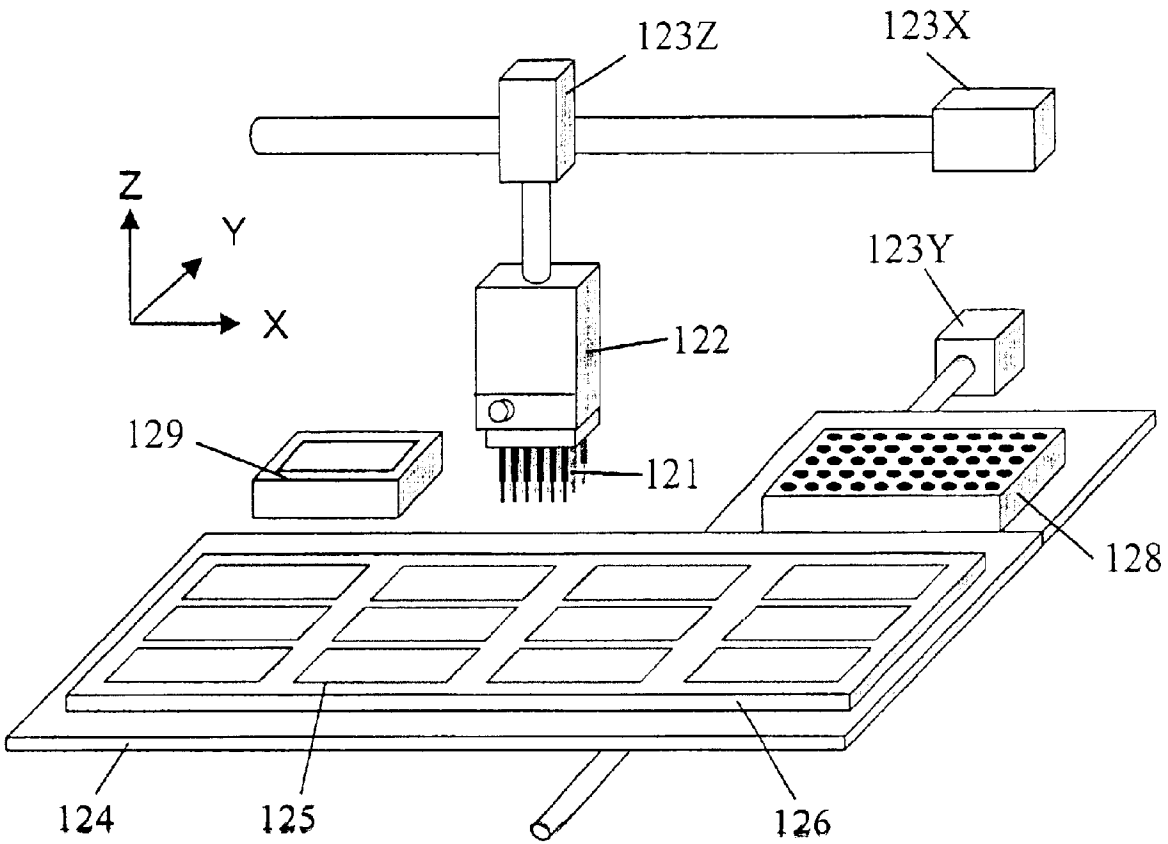
FIG. 12 shows an example of spotting equipment.
Figure 13:
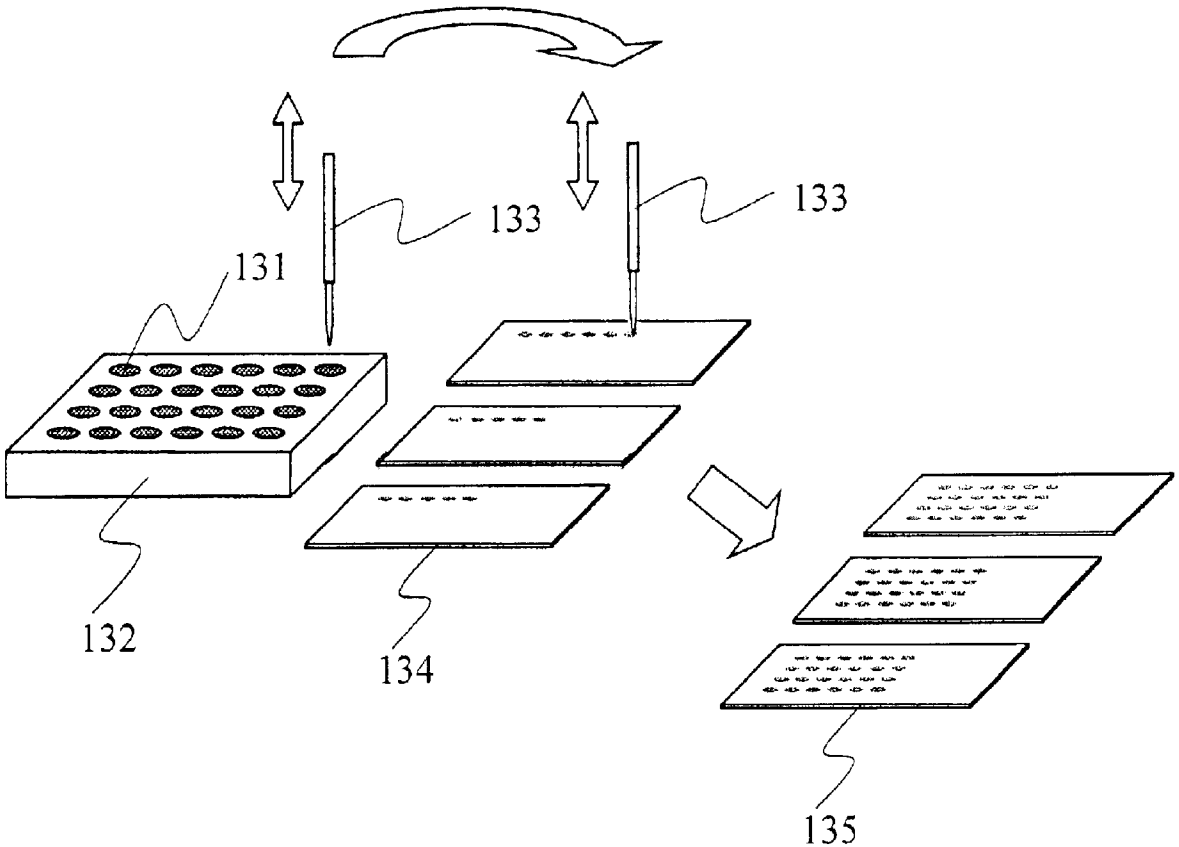
FIG. 13 shows an example of a method of producing a macroarray.

FIG. 12 shows an example of the spotting equipment. The spotting equipment includes a pin head 122 on which spotting pins 121 are mounted below, an X-motor 123X for driving the pin head 122 along the X-axis direction, a Z-motor 123Z for driving the pin head 122 along the Z-axis direction, a base 124, and a Y-motor 123Y for driving the base 124 along the Y-direction. On the base 124 is mounted a stage 126 carrying a plurality of water-absorbing supports 125 such as nylon membranes, and a microplate 128 containing multiple kinds of solutions of biopolymers such as DNA. The spotting pins 121 employ the spotting pins as described above according to the invention.

The X-and Z-direction positions of the pin head 122 are accurately controlled by the X-motor 123X and the Z-motor 123Z, and the Y-direction position of the base 124 is accurately controlled by the Y-motor 123Y. Thus, equal amounts of multiple kinds of solutions of biopolymers can be sequentially spotted on the multiple water-absorbing supports 125. When a different kind of biopolymer solution contained in the microplate 128 is to be sequentially spotted using the same spotting pins, the spotting pins are washed by a pin washing apparatus 129 before the next biopolymer solution is charged into the spotting pins in order to prevent the contamination of the solutions. Washing of the pins is carried out by a combination of ultrasound washing and vacuum drying. Specifically, the pins are vacuum-dried once after use, washed with ultrasound, and then vacuum-dried once again. In this way, the contamination of the solutions can be prevented and multiple kinds of biopolymer solutions can be spotted onto a nylon membrane, for example.

The biopolymer solution can be filled in the spotting pins of the invention in the following manner. When there is no need of sequential spotting, the biopolymer solution is only filled in the solution holding portion at the tip of the first member before each spotting, so that a quantitative spotting can be carried out each time. Then, the biopolymer solution is filled in the solution supply portion of the second member, so that a sequential spotting can be carried out. By dipping the tip directly into the biopolymer solution while the solution holding portion of the first member is connected to the solution supply portion of the second member, the solution can be filled into the solution supply portion of the second member by the capillary action. When it is necessary to spot a large quantity of biopolymer solution to a number of supports, pins with large-volume solution reservoirs are employed as the spotting pins, and the biopolymer solution can be filled into the solution reservoirs from above.

Thus, in accordance with the invention, equal amounts of multiple kinds of spotting solutions containing biopolymers such as DNA, RNA, and proteins can be spotted on a water-absorbing support in a sequential and stable manner.

What is claimed is:

1. A spotting pin for spotting a solution on a water-absorbing support, comprising:

a first member comprising a solution holding portion opening into a front and back surface of the tip of the first member which comes into contact with a support, the first member holding a predetermined amount of solution in the solution holding portion based on a capillary action, the first member further comprising a slide guide portion;

a second member comprising a solution supply portion opening into an end of the second member opposite the opening on the back surface of the solution holding portion, the solution supply portion holding the solution based on a capillary action, wherein the second member slides along the slide guide portion of the first member; and a biasing member for urging the second member against the first member such that the solution supply portion of the second member comes into contact with the solution holding portion of the first member.

2. The spotting pin according to claim 1, wherein the second member comprises a body and a branch portion extending from the body in a direction opposite the tip of the first member.

3. The spotting pin according to claim 1, wherein the second member comprises a body and a branch portion extending from the body in a direction of the tip of the first member, wherein the tip of the branch portion protrudes beyond the tip of the first member when the solution supply portion of the second member is in contact with the solution holding portion of the first member.

4. The spotting pin according to claim 1, wherein the second member comprises a large-sized solution reservoir connected to the solution supply portion.

5. The spotting pin according to claim 4, wherein a line connecting the tip of the first member and the center of the large-sized solution reservoir is in parallel to the sliding direction of the second member.

6. The spotting pin according to claim 4, wherein a line connecting the tip of the first member and the center of the large-sized solution reservoir is not in parallel to the sliding direction of the second member.

7. The spotting pin according to claim 1, wherein a periphery of the surface of the tip of the first member is cut to have a reduced area of contact with the support, and wherein a periphery of the tip of the second member opposite the back surface of the tip of the first member is cut to have a reduced area of contact with the back surface of the tip of the first member.

8. The spotting pin according to claim 1, wherein the biasing member is a compression spring disposed between the inner wall of a rear end portion of the first member and the second member, such that the compression spring acts to press the second member against the tip of the first member.

9. The spotting pin according to claim 1, wherein the first and second members are made of austenitic stainless steel.

10. A spotting pin for spotting a solution on a water-absorbing support, comprising:

a first member comprising a plurality of solution holding portions each having an opening on a front and back surface of the tip of the first member which comes into contact with the support, and a slide guide portion, each solution holding portion holding a predetermined amount of the solution based on a capillary action;

a second member comprising a plurality of solution supply portions each having an opening on an end of the second member opposite the opening on the back surface of the solution holding portion and holding the solution based on a capillary action, wherein the second member slides along the slide guide portion of the first member; and a biasing member for urging the second member against the first member such that the multiple solution supply portions of the second member come into contact with the multiple solution holding portions of the first member.

11. The spotting pin according to claim 10, wherein the first and second members are made of plastics.

* * * * *